US005155311A

United States Patent [19]

Utke

[11] Patent Number: 5,155,311

[45] Date of Patent: Oct. 13, 1992

[54] FLOAT SWITCH ASSEMBLY FOR SUBMERSIBLE PUMP

[75] Inventor: Gene Utke, Rochert, Minn.

[73] Assignee: S.J. Electro Systems, Inc., Detroit Lakes, Minn.

[21] Appl. No.: 725,536

[22] Filed: Jul. 3, 1991

[51] Int. Cl.[5] ..... H01H 35/18

[52] U.S. Cl. ..... 200/84 C; 73/313; 200/81.4; 335/205; 417/40

[58] Field of Search ..... 137/428, 429, 558; 417/40, 36; 340/623, 624; 73/308, 313, 319; 335/205, 206, 207; 200/61.2, 81.4, 84 R, 84 C, 82 E, 83 L, 81.9 M, 302.1

[56] References Cited

U.S. PATENT DOCUMENTS

| | | | |
|---|---|---|---|
| 1,179,377 | 2/1916 | Weed . | |
| 1,838,135 | 12/1931 | Derby . | |
| 2,726,296 | 12/1955 | Hanson . | |
| 4,027,278 | 5/1977 | Gianinni | 335/154 |
| 4,066,858 | 1/1978 | Piper | 200/84 C |
| 4,647,740 | 3/1987 | Hanson, III . | |
| 4,742,195 | 5/1988 | Bryant | 200/302.1 |
| 4,865,073 | 9/1989 | Kocher . | |

FOREIGN PATENT DOCUMENTS

| | | | |
|---|---|---|---|
| 561772 | 8/1958 | Canada | 200/84 C |

*Primary Examiner*—Gerald P. Tolin
*Attorney, Agent, or Firm*—Vidas & Arrett

[57] ABSTRACT

A magnetically actuated float switch assembly for use with a submersible pump, comprises a float rod with two spaced stops, a movable float carried by the rod which moves between the stops in response to fluid level, the rod being mounted in a vertical oriented position for movement upwardly and downwardly in response to float movement against the two spaced stops, a magnetic body carried at the upper end of the rod for movement therewith, a generally U-shaped magnetic follower element with two spaced, magnetically responsive arms on one side of the magnetic body, or two sets of arms disposed on either side of the magnetic body to provide a dual U-shaped arrangement, the follower element being rotatably mounted with the arms thereof in a generally horizontal position, one above the other for movement of the arms thereof upwardly and downwardly in a vertical plane, the arms and magnetic body being positioned relative to each other so as to dispose the magnetic body for movement from arm to arm to thereby allow proximity actuation of the follower by magnetic attraction between an arm and the magnetic body, electrical contact means carried by the follower element, and fixed electrical contact means adapted to make and break with the follower electrical contact means as the follower arms move downwardly and upwardly, respectively, in response to proximity actuation by the magnetic body as controlled by float movement against the stops on the rod.

11 Claims, 3 Drawing Sheets

FLOAT SWITCH ASSEMBLY FOR SUBMERSIBLE PUMP

BACKGROUND OF THE INVENTION

1. Field Of The Invention

This invention relates to the general art of float switch assemblies and more particularly to magnetically actuatable float switches intended for use with pumps. Although the float switch assembly can be used with submersible and non-submersible pumps as well, it is described herein with specific reference to the operation of submersible pumps as the preferred use of the invention. The switch in its most preferred embodiment is characterized by providing it in a hermetically sealed compartment along with a permanent magnetic body and twin armatures adapted to sequentially "make" or "break" electrical contacts in an electrical circuit, and a contact-actuating mechanism.

2. Description Of The Related Art

Sump pumps and the like generally use two types of switching mechanisms. One type is a tethered cord float switch. A drawback of this type of switch is that to increase the pumping differential, the length of the cord must be increased. This can be problematic if the pump is to be operated in smaller diameter sumps, for example, as the tethered cord switch would not have enough room to operate adequately and could possibly cause the float to hang up. To overcome this problem, some sump pump manufacturers rigidly attach a rod mounted vertically along the outer pump housing. A float with a hollow center rides up along the rod and at a certain height will actuate a switch, turning on the pump. As long as the pump can fit in the sump, there should be no interference. Examples of this type of pump and switch arrangement are found in U.S. Pat. No. 1,170,377 to Weed and U.S. Pat. No. 1,838,135 to Derby.

Float switches having a magnetic arrangement of sorts at the upper end of the rod for actuating a contact switch have been described in U.S. Pat. No. 2,726,296 to Hanson, U.S. Pat. No. 4,647,740 to Hanson III, and U.S. Pat. No. 4,865,073 to Kocher.

Operation with a sump pump requires equipment that will assure certainty of operation over long periods of time. This invention fulfills a need which has developed for an improved magnetically actuatable float switch assembly for use with sump pumps, and the like. In its most preferred form it also provides a hermetically sealed environment for the electrical contacts and the contact-actuating mechanism, thereby assuring a longer operating life, greater reliability and less wear and tear on parts of the switch assembly.

SUMMARY OF THE INVENTION

The invention in its most preferred embodiment is directed to a magnetically actuatable float switch for use with sump pumps and the like, the switch assembly comprising a float rod with two spaced, adjustable stops between which a float carried by the rod moves in response to fluid level in the sump. A reciprocating magnetic body is carried at the upper end of the rod, which is mounted in a vertical oriented position for movement upwardly and downwardly in response to float movement against the two spaced stops. A generally U-shaped magnetic follower element or armature with two vertically spaced, magnetically responsive arms, is rotatably mounted such that the arms are situated horizontally, one above the other, and may move upwardly and downwardly in a vertical plane, the arms and magnetic body being positioned relative to each other so as to dispose the magnetic body for movement from arm to thereby allow proximity actuation of the follower by magnetic attraction between the arms and the magnetic body. Preferably, a dual set of such arms is provided as is described further hereinbelow. As the follower element arms move upwardly and downwardly, respectively, in response to proximity actuation by the magnetic body as controlled by float movement against the stops on the rods, an electrical contact means carried by the follower element makes and breaks with a fixed electrical contact means, thereby switching the pump on and off. In an even more preferred form, the follower element includes dual, U-shaped arms, each of which are laterally spaced on opposite sides of the magnetic body and operate in unison. The invention further provides an embodiment in which a hermetically sealed environment is provided for the magnetic body and its follower element, the electrical contacts and the contact-actuating mechanism. Also, a filtered float chamber may be provided.

BRIEF DESCRIPTION OF THE DRAWINGS.

The features of the present invention which are believed to be novel are set forth with particularity in the appended claims. The invention, together with further objects and advantages thereof, may be best understood by reference to the following description taken in conjunction with the accompanying drawings, wherein like reference numerals identify like elements, throughout and in which:

DETAILED DESCRIPTION OF THE PREFERRED EMBODIMENTS

Figure 1:
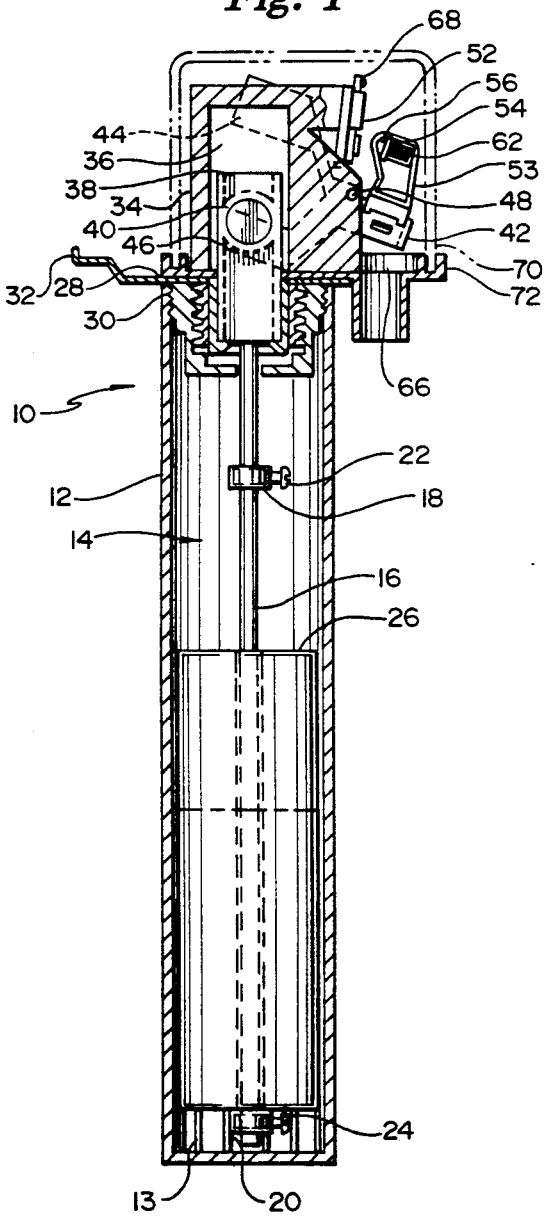
FIG. 1 is a vertical sectional view through a magnetically controlled float switch according to the invention, showing the contact points open and the fluid level low.
Figure 2:
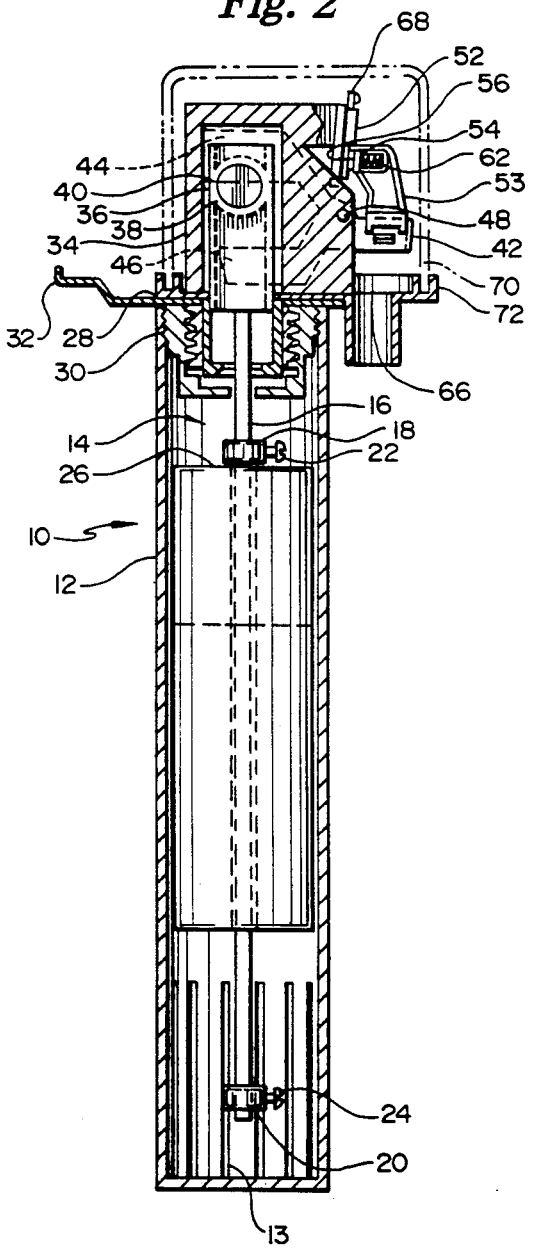
FIG. 2 is a vertical sectional view as in FIG. 1, showing the contact points closed and the fluid level high.

Referring to FIGS. 1 and 2, a magnetically controlled float switch, generally indicated at 10 comprises a float mechanism, generally indicated at 14, optionally covered by a casing or screen 12, further comprising a float rod 16 and two spaced stops, an upper limit stop 18 and a lower limit stop 20, secured by upper and lower set screws 22,24, and a moveable float 26 carried by rod 16 positioned between stops 18,20 and moveable therebetween in response to the fluid level. Float mechanism 14 is joined with an essentially flat base support 28 by means of a bushing 30. A metal mount 32 for securing float switch 10 to a pump or the like is disposed between bushing 30 and base support 28.

A relatively thin upright housing element 34 stands on the surface of base support 28. This may be a block of plastic, or other non-magnetic material. An opening extends upwardly through base support 28 in communication with a receiving cavity 36 formed in housing element 34 for upward and downward movement of a reciprocating element 38 received therein. Float rod 16 is attached to reciprocating element 38, which moves with the rod up and down in response to movement of float 26 between upper and lower limit stops 18,20. Rod 16 and reciprocating element 38 may also be of one piece as of molded plastic. A magnetic body 40 is carried by reciprocating element 38 for movement with rod 16. A generally U-shaped magnetic follower element 42 having two spaced magnetically responsive arms, an upper arm 44 and a lower arm 46, is mounted on housing 34 by means of a pivot 48. Alternatively, follower element 42 may be made of a magnetic material, in which case item 40 would be a magnetic attracting body made of a magnetic attractable metal.

Figure 3:
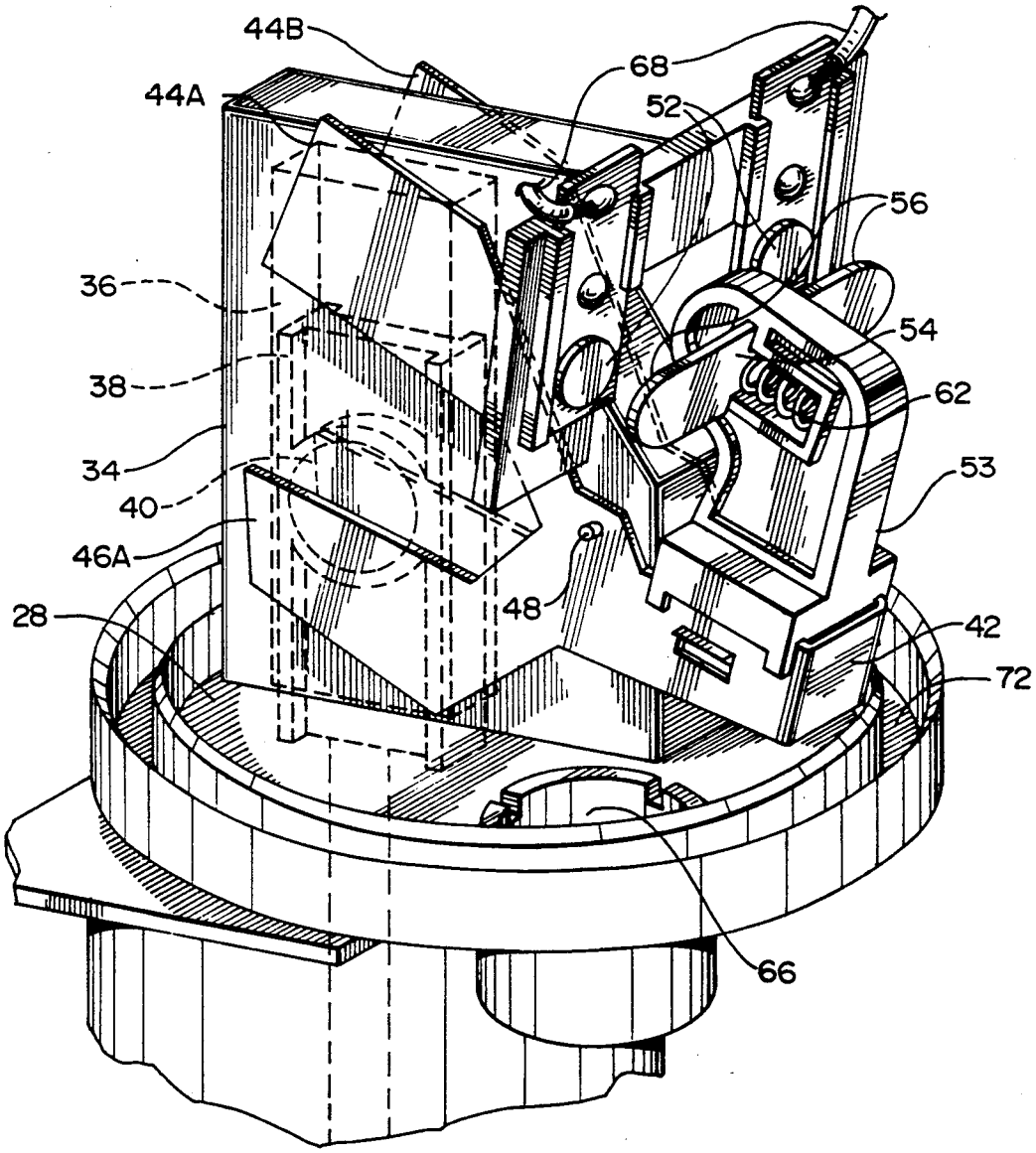
FIG. 3 is a perspective view of the sealed housing with the cap removed to show the parts as disposed therein.

In a preferred embodiment of the invention, as shown in FIG. 3 of the drawings, follower element 42 is disposed alongside of housing 34 and includes dual laterally spaced and generally U-shaped members 44*a*, 44*b*, 46*a*, 46*b*, each of which is disposed along opposite sides of housing element 34, to provide a dual U-shaped armature arrangement. Arms 44*a*, 44*b*, 46*a*, 46*b* and magnetic body 40 are positioned relative to each other so as to dispose magnetic body 40 therebetween for movement between upper arms and lower arms, thereby allowing proximity actuation of follower element 42 by magnetic attraction between arms 44*a* and 46*a* and magnetic body 40 or between arms 44*b* and 46*b* and magnetic body 40.

A pair of fixed electrical contacts 52 is carried by housing 34 transverse of the upright edge of housing 34 and attached above pivot point 48 of follower element 42 with one contact disposed to each side of housing 34 and follower arms 44*a*,44*b*,46*a*,46*b*. A moveable contact support 53, including a transverse bar 54 which carries a pair of spaced electrical contacts 56 arranged for mating with fixed contacts 52 is carried by follower element 42 above pivot point 48 thereof and extending across the upright edge of housing element 34. Electrical contact is effected through lateral movement of transverse bar 54, in response to movement of follower element 42. In a preferred embodiment transverse bar 54 is carried by moveable contact support 53 and includes a biasing spring 62. Biasing spring 62 is used for biasing contacts 56 toward fixed contacts 52 to ensure that electrical contact is made when follower element 42 is in the closed position, as shown in FIG. 2, and also to take up contact bounce. Base 28 is further equipped with an opening 66 for electrical contact wires 68, which attaches to fixed contact means 52 located on housing element 34.

Figure 4:
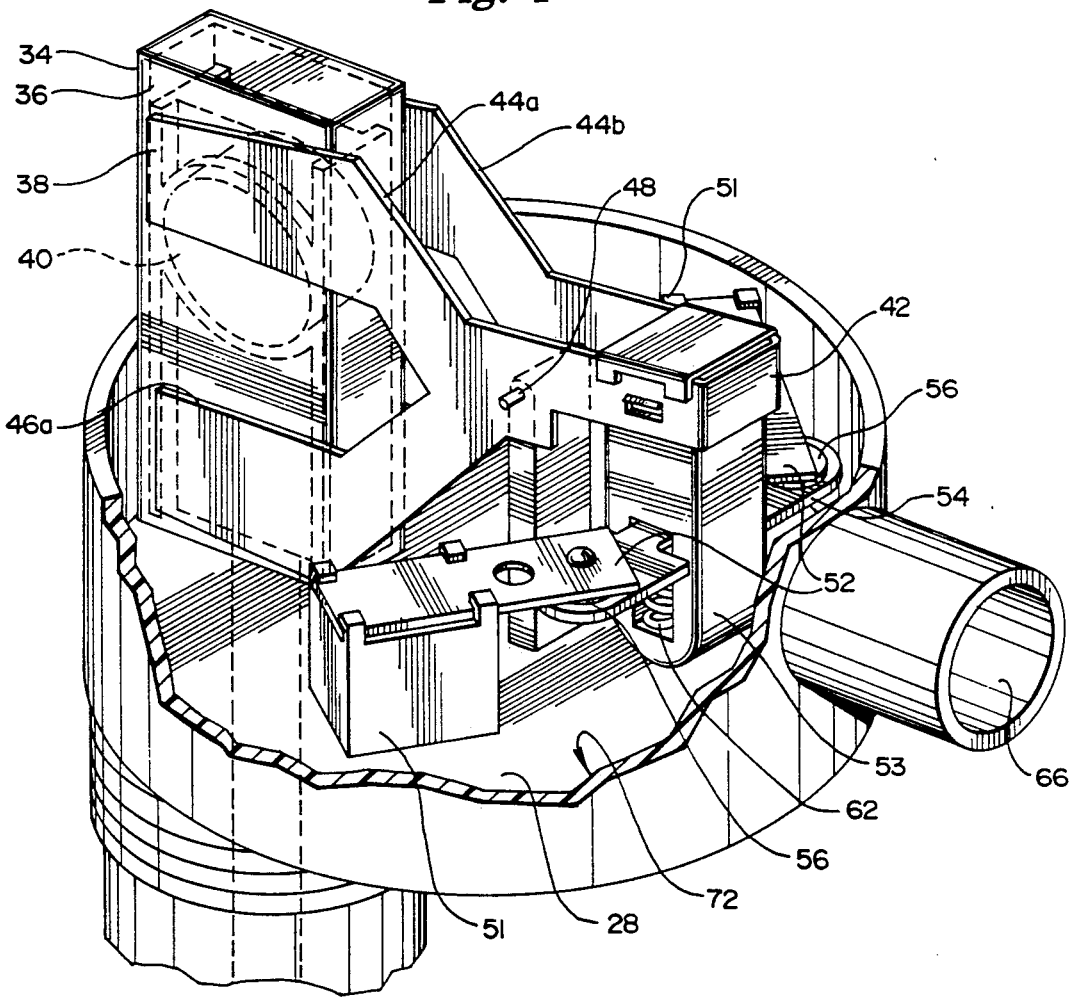
FIG. 4 is a perspective view of an alternative embodiment of the sealed housing with the cap removed to show the parts as disposed therein.

Referring now to FIG. 4, in which like numbers are used to designate like elements referred to in FIG. 3 above, an alternative embodiment of the invention is shown in which fixed electrical contacts 52 are attached to base 28 by means of fixed contact supports 51 disposed to either side of moveable contact block 53 which is carried below pivot point 48 of follower element 42. In this embodiment, transverse bar 54 carrying spaced electrical contacts 56 is horizontal to base 28, and moves vertically to effect electrical contact.

A unique feature of the invention is the manner in which the assembly is enclosed for protection. Referring to FIG. 1, the switch assembly is shown protected by a cap 70 which fits in a groove 72 formed around the outer edge of base 28. The entire switch assembly is hermetically sealed as follows: where base 28 meets cap 70; where base 28 meets element 34; and at opening 66 for electrical wire 68, to ensure that the switch assembly is water and vapor tight. Housing element 34 is preferably molded to the surface of base support 28, or housing element 34 may be sealingly attached, as by plastic sealant, adhesive or the like, to the surface of base support 28 thereby sealing off the switch assembly from receiving cavity 36 formed in housing element 34 which communicates with float mechanism 14. Most preferably, base 28 and housing 34 will be a single unitary molded plastic part. Also, as an option, casing or screen 12 shown in FIGS. 1 and 2 can be attached to protect float 26 from debris or foreign material that might enter float mechanism 14, impairing the float's function. In a preferred embodiment, float casing 12 is equipped with slits 13 designed to filter the liquid entering float mechanism 14.

In operation, float 26 is allowed to travel freely up and down rod 16 due to rising and falling liquid levels. Set points or stops 18,20 for pump "on" and pump "off" are adjustable and are positioned above and below float 26. When the liquid level rises, float 26 travels vertically along rod 16 until reaching upper limit stop 18 at which point float 26 will lift rod 16. Connected to rod 16 is a structure or reciprocating element 38 that holds magnetic body 40 so if rod 16 is rising, magnetic body 40 will also rise. Magnetic body 40 rises and at a certain point the magnetic field attracts upper metal arm 44 of follower element 42 causing it to rotate downwardly thereby "closing" switch contacts 52,56 and starting the pump. As the water level falls, float 26 travels down rod 16 but rod 16 remains motionless because of the magnetic attraction between magnetic body 40 and arm 44 of follower element 42. This phenomena is desirable to create a pumping differential. When float 26 reaches lower limit stop or set point 20 on rod 16, the water continues to fall so that the downward force exerted at lower set point 20 increases. The increase in downward force causes magnetic body 40 to start moving downwardly. While magnetic body 40 is moving down, the magnetic field attracts and pulls upper metal arm 44 of follower element 42 and increases the contact pressure. At a certain point in time, the weight at lower limit stop 20 becomes greater than the magnetic force between magnetic body 40 and upper metal arm 44 of follower element 42 and causes the magnetic force to be broken. At this time rod 16 and magnetic body 40 travel rapidly in the downward direction and at a faster rate than the downward travel of float 26. As magnetic body 40 is traveling downward there is a point at which there becomes a magnetic attraction between magnetic body 40 and lower metal arm 46 of follower element 42 thereby causing arm 46 to rotate upwardly and open contacts 52,56 stopping the pump. The position of stops 18,20 on rod 16 may be adjusted so that different pumping ranges can be achieved.

This completes the description of the preferred and alternate embodiments of the invention. Those skilled in the art may recognize other equivalents to the specific embodiment described herein which equivalents are intended to be encompassed by the claims attached hereto.

What is claimed is:

1. A float switch assembly comprising in combination:

a float rod and two spaced stops positioned along the length thereof;

a movable float carried by the rod and positioned between the stops and movable therebetween in response to fluid level;

means mounting the rod in a vertical oriented position for movement upwardly and downwardly in response to float movement against the two spaced stops;

a magnetic body carried at the upper end of the rod for movement therewith;

a base support having a substantially flat upper surface;

a relatively thin upright housing element standing on the surface;

an opening extending upwardly through the base support in communication with a cavity in the housing element;

the upper end of the rod being received in the cavity for upward and downward reciprocating movement of the magnetic body therein;

a follower element comprising a pair of generally U-shaped members oppositely disposed exteriorly of and to the upright sides, respectively, of the upright housing element and fixed together for joint movement, the follower being pivotally mounted on the housing element;

means rotatably mounting the follower element with the arms thereof in a generally horizontal position, one above the other, and for movement of the arms thereof upwardly and downwardly in a vertical plane, the arms and magnetic body being positioned relative to each other so as to dispose the magnetic body for movement between the upper and lower arms to thereby allow proximity actuation of the follower by magnetic attraction between the arms and the magnetic body;

a pair of fixed electrical contacts carried transverse of the upright edge of the housing and positioned with one contact disposed to each side of the housing and the follower arms; and a moveable contact support which carries a transverse bar including a pair of spaced electrical contacts arranged for mating with the fixed contacts, the contact support being carried by the follower element for making and breaking electrical contact with the fixed contacts in response to movement of the follower element.

2. The float switch assembly of claim 1 wherein:

the contact support is carried below the pivot point of the follower element, the fixed electrical contacts are attached to the base by means of fixed contact supports disposed to either side of the moveable contact support; and the transverse bar carrying the spaced electrical contacts is horizontal to the base, and moves vertically with the follower element to make and break electrical contact.

3. The float switch assembly of claim 1 wherein the cavity in the housing element is flat and rectangular and the reciprocating element is shaped to slidably mate therewith, the magnetic body being disc-like in shape and carried flat in an opening therein.

4. The float switch assembly of claim 1 wherein the cavity and reciprocating element are mutually shaped to mate together.

5. The float switch assembly of claim 1 wherein the transverse bar is spring biased.

6. The float switch assembly of claim 1 including a cover enclosing the upper surface of the base support and all elements thereon.

7. The float switch assembly of claim 1 in which the stops are positionally adjustable.

8. A float switch assembly comprising:

a float rod and two adjustable spaced stops positioned along the length thereof;

a movable float carried by the rod and positioned between the stops and movable therebetween in response to the fluid level;

a base support having a substantially flat upper surface;

a relatively thin upright housing element standing on the surface of the base support;

an opening extending upwardly through the base support in communication with a flat, rectangular cavity in the housing element;

a reciprocating element carried at the upper end of the rod for movement with the rod, said reciprocating element being shaped to slidable mate with the cavity in the housing element for upward and downward reciprocating movement therein;

a disc-like magnetic body carried by the reciprocating element;

a magnetically responsive follower element further comprising a first generally U-shaped member disposed along one side of the upright housing element, and a second U-shaped member disposed along the other side of the upright housing element, said first and second U-shaped members being fixed together for joint movement, the follower being pivotally mounted on the housing element with the arms of said U-shaped members in a generally horizontal position, one above the other, for movement of the arms thereof upwardly and downwardly in a vertical plane, the arms and magnetic body being positioned relative to each other so as to dispose the magnetic body for movement from arm to arm to thereby allow proximity actuation of the follower by magnetic attraction between the arms and the magnetic body;

a pair of fixed electrical contacts attached to the base by means of fixed contact supports disposed to either side of the housing and the follower arms;

a moveable contact support carried by the follower element below the pivot point, including a spring biased transverse bar which carries a pair of spaced electrical contacts arranged for mating with the fixed electrical contacts, the transverse bar being carried by the contact support horizontal to the base, said transverse bar moving vertically with the follower element for making and breaking electrical contact with the fixed contacts in response to movement of the follower element downwardly and upwardly, respectively, in response to proximity actuation by the magnetic body, controlled by float movement against the stops on the rod; and a cover enclosing the upper surface of the base support and all elements thereon.

9. A magnetic switch assembly comprising:

a magnetic body adapted for reciprocating movement;

a magnetically responsive follower element comprising a first generally U-shaped member, having an upper arm and a lower arm disposed to one side of the magnetic body, and a second generally U-shaped member having an upper arm and a lower arm disposed to the other side of the magnetic body, the first and second U-shaped members being fixed together for joint movement, the follower being adapted to be pivotally mounted with the arms of the U-shaped members and magnetic body being positioned relative to each other so as to dispose the magnetic body for movement therebetween to thereby allow proximity actuation of the follower by magnetic attraction between the arms and the magnetic body in passing;

first electrical contacts adapted for movement by the follower;

second electrical contacts positioned for contact with the first contacts; and positioning means for positioning the second contacts for making and breaking contact with the first contacts upon movement thereof.

10. A magnetically operable switch, comprising: a magnetic body adapted for reciprocable movement;

follower means comprising a first U-shaped magnetically responsive member positioned on one side of the magnetic body and a second U-shaped magnetically responsive member positioned on the opposite side of the magnetic body, said first and second magnetically responsive members being joined together for joint movement thereof, thereby providing a pair of spaced arms to each side of said magnetic body between which the magnetic body moves in its reciprocable motion;

a pivot means mounting the follower member for pivotal movement in response to movement of the magnetic body between the follower arms;

a first electrical contact means carried by the follower for movement therewith; and mating electrical contact means adapted to make and break with the first contact means upon its movement.

11. A magnetic switch assembly comprising:

a disc-like magnetic body adapted for reciprocable movement;

a magnetically responsive follower element comprising a first generally U-shaped member positioned on one side of the magnetic body, said member including an upper arm and a lower arm disposed to one side of the magnetic body, and a second generally U-shaped member positioned on the other side of the magnetic body, said second member including an upper arm and a lower arm, the two members being fixed together for joint movement, the follower being adapted to be pivotally mounted with the arms of the U-shaped members in a generally horizontal position, one above the other, for movement of the arms thereof upwardly and downwardly in a vertical plane, the arms and magnetic body being positioned relative to each other so as to dispose the magnetic body for movement from arm to arm to therby allow proximity actuation of the follower by magnetic attraction between the arms and the magnetic body;

a first pair of electrical contacts; and a moveable contact support carried by the follower element below the pivot point, including a spring biased transverse bar which carries a second pair of electrical contacts arranged for mating with the first electrical contacts, said transverse bar moving vertically with the follower element for making and breaking electrical contact with the first contacts in response to movement of the follower element downwardly and upwardly, respectively, in response to proximity actuation by the magnetic body.

* * * * *